United States Patent [19]

Perlino

[11] 4,378,746

[45] Apr. 5, 1983

[54] APPARATUS FOR MAKING POCKETS OF THE STRIP TYPE WITH SLIDE FASTENER

[75] Inventor: Silvano Perlino, Pavia, Italy

[73] Assignee: Necchi Societa per Azioni, Pavia, Italy

[21] Appl. No.: 40,400

[22] Filed: Jun. 21, 1979

[30] Foreign Application Priority Data

May 19, 1978 [IT] Italy ..... 42907 A/78

[51] Int. Cl.[3] ..... D05B 3/12

[52] U.S. Cl. ..... 112/104; 112/65

[58] Field of Search ..... 112/104, 235, 65, 70

[56] References Cited

U.S. PATENT DOCUMENTS

| | | | |
|---|---|---|---|
| 2,573,359 | 10/1951 | Rich | 112/65 |
| 3,105,973 | 10/1963 | Stiefelmeier | 112/65 X |
| 3,653,345 | 4/1972 | Bianchi | 112/65 |
| 3,680,510 | 8/1972 | Ebata | 112/235 |
| 3,745,946 | 7/1973 | Bianchi | 112/65 |
| 3,747,544 | 7/1973 | Nicolay et al. | 112/65 |
| 4,006,695 | 2/1977 | Van Amburg | 112/104 |

*Primary Examiner*—H. Hampton Hunter

*Attorney, Agent, or Firm*—Stevens, Davis, Miller & Mosher

[57] ABSTRACT

A process for producing pockets of a strip type with a slide fastener, comprising conducting a continuous slide-fastener tape towards the sewing area of a strip-pocket sewing machine, separating portions of the tape, with the teeth of the slide fastener tape located towards the outside, sewing the tape simultaneously on the main fabric and on the pouch of the pocket itself on said fabric, cutting said pouch and fabric centrally between the seams as the seams are formed, and cutting at the end of the sewing and cutting operation two V-shaped notches in the main fabric and in the pouch at a place corresponding to the two end portions of said cut and apparatus for carrying out the process.

1 Claim, 5 Drawing Figures

APPARATUS FOR MAKING POCKETS OF THE STRIP TYPE WITH SLIDE FASTENER

This invention relates to a process for making pockets of the strip type with a slide fastener and an apparatus for carrying out the process. More particularly, the purpose of the invention is to automate the carrying out of the first step of the operating cycle of the formation of a pocket of the type indicated in order to reduce the time required for same.

The technical problem to be solved in achieving this purpose was to provide an apparatus suitable for continuously supplying a slide-fastener tape to the sewing and cutting area of a sewing machine of the type for the production of strip pockets, suitably modified in order to obtain this new feature.

The process forming the object of the invention is characterized by the fact that a continuous slide-fastener tape is conducted towards the sewing area of a machine for the sewing of strip pockets. The separate portions of the said tape, with the teeth of the slide fastener arranged to the outside, are sewn simultaneously on the main fabric and on the pouch of the pocket spread on the fabric. The pouch and fabric are cut centrally along the seams as they are made and, at the end of the sewing and cutting operation, two V-shaped notches are made on the main fabric and on the pouch at the position of the two extreme end portions of the cut.

The apparatus for carrying out the process is composed of a roller on which there is wound a slide-fastener tape, a sewing machine for the making of strip pockets which is provided with a work support plane which is movable, together with a presser frame located above it, with respect to two needles and a knife which are supported on the machine and capable of carrying out vertical reciprocal movement to produce on the work two parallel seams and a cut which is parallel and central with respect to the seams. The presser frame is provided with two longitudinal guides which engage with the teeth of the two portions of the slide-fastener tape. The sewing machine is furthermore provided with two reversible knives capable of forming two V-shaped incisions at the two ends of the cut formed by the knife.

Further advantages and characteristics of the invention will be more evident from the following description and from the accompanying drawings in which:

FIGS. 1 and 5 show an automatic sewing unit 10 already used in the prior art to obtain the formation of strip pockets on various garments.

Figure 1:
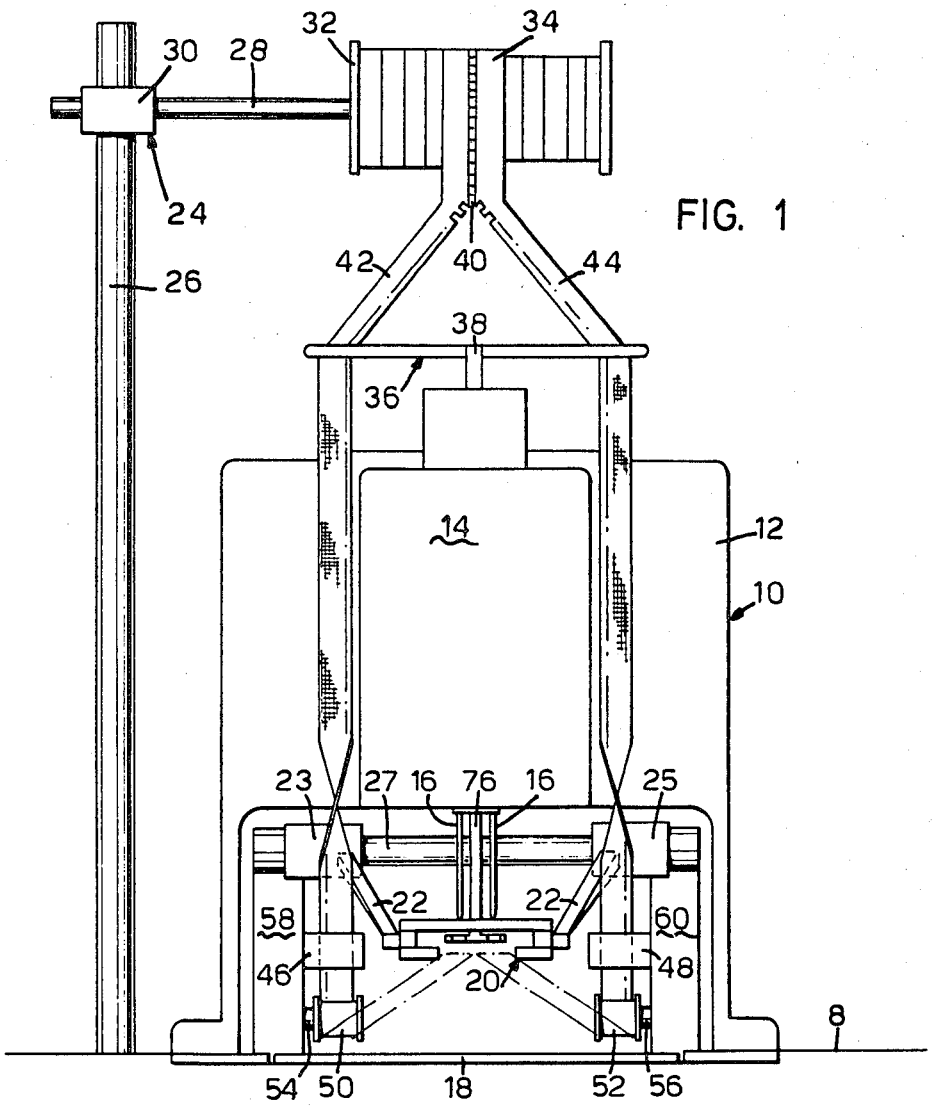
FIG. 1 is a front view of the apparatus capable of carrying out the process of the invention.

This automatic unit 10 comprises a sewing machine 12 supported on a table 8 and provided with a head 14 in which there are contained the drive means for obtaining the reciprocal motion of the needles 16. A detailed description of such a sewing machine is contained in U.S. Pat. No. 3,653,345.

The work support plane 18 is movable longitudinally with respect to the sewing machine 12 as well as is the presser frame 20 articulated on two arms 22 which in their turn are pivoted at opposite ends on suitable sleeves 23, 25 supported by a shaft 27 so as to permit the frame 20 to oscillate away from and towards the work support plane 18.

On the table 8 of the automatic unit 10 there is mounted a support 24 composed of a vertical arm 26 and of a horizontal arm 28, which arms are connected together by a block 30 which is displaceable along the vertical arm so as to regulate the vertical position of the horizontal arm 28. On the latter arm there is mounted, axially rotatable, a roller 32 on which there is wound a continuous slide-fastener tape 34. The tape is brought towards the sewing area of the sewing machine 12 via a first guide 36 formed by a horizontal arm 28 supported on the upper part of the sewing machine 12. At the end of arm 38 there are provided suitable guides which effect the division of the tape 34 at the position of the teeth 40 into two portions 42 and 44. The portions then descend vertically and are threaded into two new guides 46 and 48 (FIGS. 1, 2, 3) after having turned over 180° so as to place the teeth 40 on the outer part of the two portions 42 and 44.

Behind the guides 46, 48 there are provided two rollers 50, 52 which are mounted for free rotation on pins 54, 56. The guides 46 and 48 as well as the rollers 50, 52 are fastened to the two uprights 58, 60 which are fastened on the work plane 18 and movable with it. The uprights 58 and 60 support the shaft 27.

Behind the rollers 50, 52 the two portions of tape are conducted towards the presser frame 20. The frame 20 (FIG. 2) is composed of the outer arms 62, 64 connected at front by a cross member 65.

Figure 4:
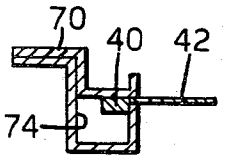
FIG. 4 is a sectional view along the line 4—4 of FIG. 3.

On the upper part of arms 62, 64 there are fastened pins 66 adapted to be engaged in buttonholes 68 provided on two plates 70, 72 which in the inner part of the frame have two seats 74 (FIG. 4) between which there are guided the teeth 40 of the portions 42, 44 of tape 34.

Due to this engagement, the two plates 70 and 72 can assume different positions in order to adapt the guides 74 to the different widths of the slide-fastener tape 34.

Figure 2:
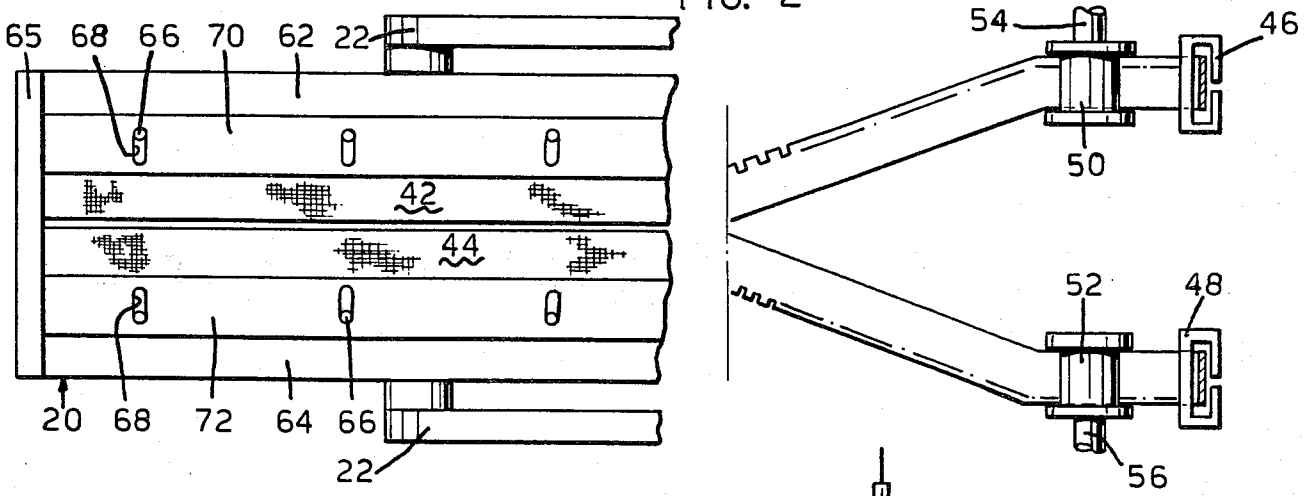
FIG. 2 is a partial view of a detail of FIG. 1.
Figure 3:
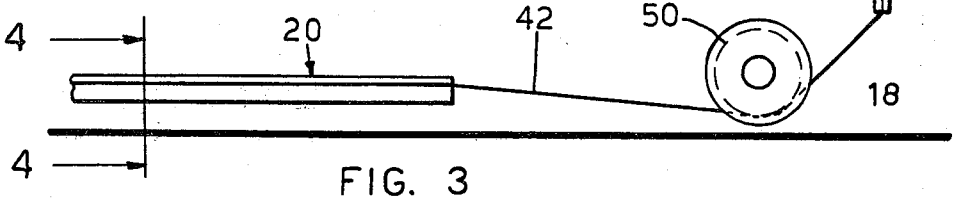
FIG. 3 is a side view of FIG. 2.

To stitch a pocket the apparatus is utilized as follows:

The continuous slide-fastener tape 34 is threaded through suitable guides 36 (46, 48 and 50,52) and finally with the teeth 40 facing outwards through the respective portions (42, 44), into suitable guides 74 provided in the plates 70, 72. The two portions (42, 44) are caused to slide in their guides for the entire length of the frame 20. They appear mounted on the frame 20 as shown in FIG. 2.

With the frame 20 raised (FIG. 1), the main fabric on which it is desired to form the pocket is placed on the work plane 18 and positioned with the help of suitable reference means, whether optical or of another type.

Figure 5:
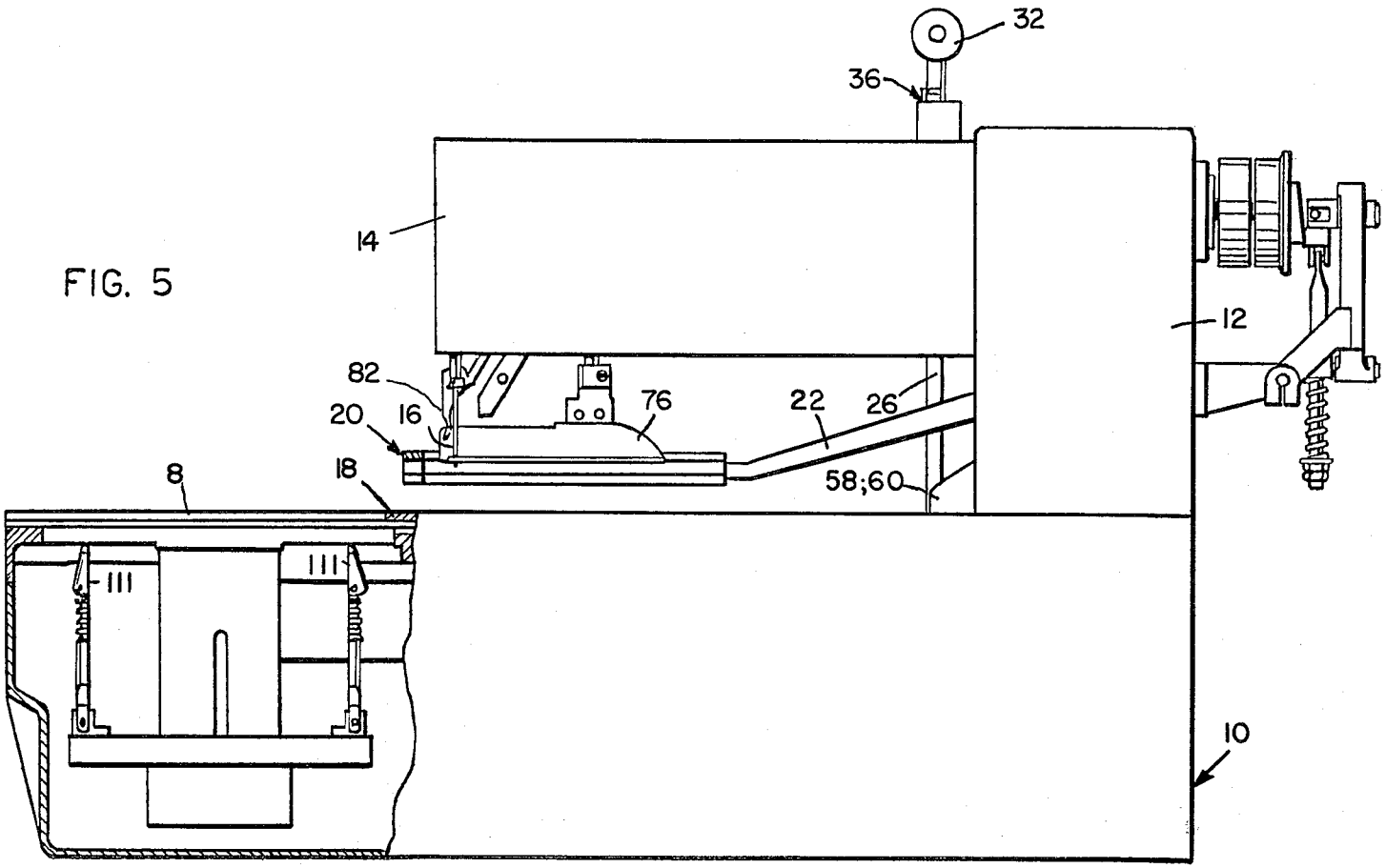
FIG. 5 shows a schematic side elevational view of a machine for sewing strip pockets.

Thereupon the presser frame 20 is lowered onto the main fabric and pouch and the machine is started. Two parallel seams for fastening the two slide fastener portions 42 and 44 are made by the needle 16, a central presser 76 being provided to hold the portions in position, and, at the same time, centrally intermediate said seams and parallel to them, the fabric is cut by a vertically reciprocating knife 82 (FIG. 5).

At the two ends of the sewing and the cutting of the fabric suitable knives 111 (FIG. 5) effect two V-shaped incisions which make it possible to turn over the edges of the main fabric, of the slide fastener portions and of the pouch and form the pouch with slide fastener closure. This can be supplemented by the use of other known means and processes.

What is claimed is:

1. An apparatus for producing pockets of a strip type with a slide fastener comprising a roller on which there is wound a slide-fastener tape, a sewing machine for the sewing of strip pockets having a movable support frame, a presser frame lying over the support frame and movable therewith, two needles and a knife supported on the sewing machine and adapted to carry out vertical reciprocations in order to produce two parallel seams on the work and a cut which is parallel and central to the seams, the presser frame being provided with two guides which engage the teeth of the two portions of the slide fastener tape, the sewing machine being further provided with two reversing knives adapted to form two V-shaped incisions at the two ends of the cut formed by the knife.

* * * * *